US011038278B2

(12) United States Patent
Bermeo et al.

(10) Patent No.: US 11,038,278 B2
(45) Date of Patent: Jun. 15, 2021

(54) LENS APPARATUS AND METHODS FOR AN ANTENNA

(71) Applicant: United States of America, San Diego, CA (US)

(72) Inventors: Dennis G. Bermeo, San Diego, CA (US); Peter S. Berens, San Diego, CA (US); Andy Kho, Chula Vista, CA (US); David V. Arney, El Cajon, CA (US); Linda I. Hau, San Diego, CA (US); Christopher C. Obra, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 127 days.

(21) Appl. No.: 16/541,569

(22) Filed: Aug. 15, 2019

(65) Prior Publication Data

US 2021/0050672 A1 Feb. 18, 2021

(51) Int. Cl.

| | |
|---|---|
| ***H01Q 15/02*** | (2006.01) |
| ***H01Q 13/04*** | (2006.01) |
| ***H01Q 1/00*** | (2006.01) |
| ***H01Q 13/00*** | (2006.01) |
| ***H01Q 17/00*** | (2006.01) |

(52) U.S. Cl.
CPC ..... *H01Q 15/02* (2013.01)

(58) Field of Classification Search
CPC ..... H01Q 13/04; H01Q 1/00; H01Q 13/00; H01Q 9/28; H01Q 17/00; H01Q 15/18; H01Q 3/00; H01Q 19/06
See application file for complete search history.

(56) References Cited

U.S. PATENT DOCUMENTS

| | | | | |
|---|---|---|---|---|
| 4,241,132 | A * | 12/1980 | Pratt | B32B 5/26 442/376 |
| 5,166,698 | A | 11/1992 | Ashbaugh et al. | |
| 7,796,885 | B2 | 9/2010 | Dress et al. | |
| 8,467,133 | B2 | 6/2013 | Miller | |
| 8,472,120 | B2 | 6/2013 | Border et al. | |
| 8,477,425 | B2 | 7/2013 | Border et al. | |
| 8,482,859 | B2 | 7/2013 | Border et al. | |
| 8,488,246 | B2 | 7/2013 | Border et al. | |

(Continued)

OTHER PUBLICATIONS

RF Component—Antenna, http://www.sharetechnote.com/html/Handbook_LTE_AntennaPerformance.html, undated article, no author provided on webpages (downloaded Jun. 23, 2019).

(Continued)

*Primary Examiner* — Wei (Victor) Y Chan

(74) *Attorney, Agent, or Firm* — Naval Information Warfare Center, Pacific; Kyle Eppele; J. Eric Anderson

(57) ABSTRACT

A lens apparatus for improving antenna performance, the apparatus involving a lens configured to at least one of focus, refocus, and refract electromagnetic energy for constructively adding gain in a far-field, the lens configured to operably couple with an antenna, whereby electromagnetic energy is omnidirectionally concentrated, whereby antenna gain and directivity are improved, whereby antenna efficiency and antenna frequency range are maintained, and whereby antenna complexity is minimized.

18 Claims, 8 Drawing Sheets

(56) References Cited

U.S. PATENT DOCUMENTS 8,814,691 B2 8/2014 Haddick et al.
8,964,298 B2 2/2015 Haddick et al.
9,097,890 B2 8/2015 Miller et al.
9,097,891 B2 8/2015 Border et al.
9,128,281 B2 9/2015 Osterhout et al.
9,129,295 B2 9/2015 Border et al.
9,134,534 B2 9/2015 Border et al.
9,182,596 B2 11/2015 Border et al.
9,223,134 B2 12/2015 Miller et al.
9,229,227 B2 1/2016 Border et al.
9,285,589 B2 3/2016 Osterhout et al.
9,329,689 B2 5/2016 Osterhout et al.
9,341,843 B2 5/2016 Border et al.
9,366,862 B2 6/2016 Haddick et al.
9,510,802 B2 12/2016 Barthe et al.
9,585,419 B2 3/2017 Stromotich et al.
9,759,917 B2 9/2017 Osterhout et al.
9,802,063 B2 10/2017 Barthe et al.
9,875,406 B2 1/2018 Haddick et al.
10,180,572 B2 1/2019 Osterhout et al.
10,268,888 B2 4/2019 Osterhout et al.
2005/0140557 A1* 6/2005 Kuroda ..... H01Q 1/38 343/773
2006/0284779 A1* 12/2006 Parsche ..... H01Q 9/28 343/773
2008/0008472 A1 1/2008 Dress et al.
2009/0237314 A1* 9/2009 Lalezari ..... H01Q 21/10 343/721
2009/0303044 A1* 12/2009 Furuichi ..... G06K 19/0776 340/568.1
2011/0213664 A1 9/2011 Osterhout et al.
2011/0214082 A1 9/2011 Osterhout et al.
2011/0221656 A1 9/2011 Haddick et al.
2011/0221657 A1 9/2011 Haddick et al.
2011/0221658 A1 9/2011 Haddick et al.
2011/0221659 A1 9/2011 King, III et al.
2011/0221668 A1 9/2011 Haddick et al.
2011/0221669 A1 9/2011 Shams et al.
2011/0221670 A1 9/2011 King, III et al.
2011/0221671 A1 9/2011 King, III et al.
2011/0221672 A1 9/2011 Osterhout et al.
2011/0221793 A1 9/2011 King, III et al.
2011/0221896 A1 9/2011 Haddick et al.
2011/0221897 A1 9/2011 Haddick et al.
2011/0222745 A1 9/2011 Osterhout et al.
2011/0225536 A1 9/2011 Shams et al.
2011/0227812 A1 9/2011 Haddick et al.
2011/0227813 A1 9/2011 Haddick et al.
2011/0227820 A1 9/2011 Haddick et al.
2011/0231757 A1 9/2011 Haddick et al.
2012/0062445 A1 3/2012 Haddick et al.
2012/0075168 A1 3/2012 Osterhout et al.
2012/0194418 A1 8/2012 Osterhout et al.
2012/0194419 A1 8/2012 Osterhout et al.
2012/0194420 A1 8/2012 Osterhout et al.
2012/0194549 A1 8/2012 Osterhout et al.
2012/0194550 A1 8/2012 Osterhout et al.
2012/0194551 A1 8/2012 Osterhout et al.
2012/0194552 A1 8/2012 Osterhout et al.
2012/0194553 A1 8/2012 Osterhout et al.
2012/0200488 A1 8/2012 Osterhout et al.
2012/0200499 A1 8/2012 Osterhout et al.
2012/0200601 A1 8/2012 Osterhout et al.
2012/0206322 A1 8/2012 Osterhout et al.
2012/0206323 A1 8/2012 Osterhout et al.
2012/0206334 A1 8/2012 Osterhout et al.
2012/0206335 A1 8/2012 Osterhout et al.
2012/0206485 A1 8/2012 Osterhout et al.
2012/0212398 A1 8/2012 Border et al.
2012/0212399 A1 8/2012 Border et al.
2012/0212400 A1 8/2012 Border et al.
2012/0212406 A1 8/2012 Osterhout et al.
2012/0212414 A1 8/2012 Osterhout et al.
2012/0212484 A1 8/2012 Haddick et al.
2012/0212499 A1 8/2012 Haddick et al.
2012/0218172 A1 8/2012 Border et al.
2012/0218301 A1 8/2012 Miller
2012/0235883 A1 9/2012 Border et al.
2012/0235884 A1 9/2012 Miller et al.
2012/0235885 A1 9/2012 Miller et al.
2012/0235886 A1 9/2012 Border et al.
2012/0235887 A1 9/2012 Border et al.
2012/0235900 A1 9/2012 Border et al.
2012/0236030 A1 9/2012 Border et al.
2012/0236031 A1 9/2012 Haddick et al.
2012/0242678 A1 9/2012 Border et al.
2012/0242697 A1 9/2012 Border et al.
2012/0242698 A1 9/2012 Haddick et al.
2012/0249797 A1 10/2012 Haddick et al.
2013/0127980 A1 5/2013 Haddick et al.
2013/0278631 A1 10/2013 Border et al.
2013/0314303 A1 11/2013 Osterhout et al.
2014/0063054 A1 3/2014 Osterhout et al.
2014/0063055 A1 3/2014 Osterhout et al.
2014/0276055 A1 9/2014 Barthe et al.
2015/0309316 A1 10/2015 Osterhout et al.
2015/0313273 A1 11/2015 Stromotich et al.
2016/0187654 A1 6/2016 Border et al.
2016/0209648 A1 7/2016 Haddick et al.
2016/0217327 A1 7/2016 Osterhout et al.
2017/0050053 A1 2/2017 Barthe et al.
2017/0164878 A1 6/2017 Connor
2017/0168566 A1 6/2017 Osterhout et al.
2017/0344114 A1 11/2017 Osterhout et al.
2018/0071554 A1 3/2018 Barthe et al.
2018/0183152 A1 6/2018 Turpin et al.
2019/0025587 A1 1/2019 Osterhout et al.
2019/0188471 A1 6/2019 Osterhout et al.

OTHER PUBLICATIONS

Cutnell, et al., "Index of Refraction," Physics, 4th Ed., V. 1, p. 782, John Wiley & Sons, Inc., Hoboken, New Jersey (1997).
Cutnell, et al., "Snell's Law of Refraction," Physics, 4th Ed., V. 1, p. 783, John Wiley & Sons, Inc., Hoboken, New Jersey (1997).
Balanis, "Antenna Lens Reference", Antenna, Theory, Analysis and Design, 3rd Ed., p. 8, John Wiley & Sons, Inc., Hoboken, New Jersey (Apr. 4, 2005).
Schantz, "The Arts of Ultrawideband Antennas," The Art and Science of Ultrawideband Antennas, 2nd Ed., p. 228, Artech House (Jun. 1, 2015).

* cited by examiner

LENS APPARATUS AND METHODS FOR AN ANTENNA

FEDERALLY-SPONSORED RESEARCH AND DEVELOPMENT

The United States Government has ownership rights in the subject matter of the present disclosure. Licensing inquiries may be directed to Office of Research and Technical Applications, Naval Information Warfare Center, Pacific, Code 72120, San Diego, Calif., 92152; telephone (619) 553-5118; email: ssc_pac_t2@navy.mil. Reference Navy Case No. 104,104.

TECHNICAL FIELD

The present disclosure technically relates to antennas. Particularly, the present disclosure technically relates to apparatuses for improving antenna performance.

BACKGROUND OF THE INVENTION

In the related art, various related art antenna systems have been implemented, such as conical and biconical antennas. Referring to FIG. 1, this diagram illustrates, in a side view, an antenna A, in accordance with the prior art. The antenna A typically comprises an upper antenna element 30, a lower antenna element 40, and a feed 50 from the lower antenna element 40 to the upper antenna element 30. The antenna A has an antenna gain G that equals a directivity D of the antenna A multiplied by an efficiency E of the antenna A. The antenna efficiency E is the ability of the antenna A to transfer energy from a feed 50, such as a radio-frequency (RF) cable or a feed cable, to the antenna A, including energy absorbed by the antenna A, itself, if the antenna A experiences any losses.

Related art techniques use multiple antennas to achieve improvement in antenna gain, thereby resulting in undue weight and complexity. Further, related art lens antennas only improve antenna gain in one particular direction. Challenges experienced in the related art include limited performance, e.g., limited gain and limited directionality, e.g., related art directional antennas, wherein electromagnetic energy is directed towards only a specific direction. Therefore, a need exists in the related art for the improving antenna performance, such as by improving antenna gain in all directions.

SUMMARY OF INVENTION

To address at least the needs in the related art, the present disclosure involves a lens apparatus for improving antenna performance, the apparatus comprising: a lens configured to at least one of focus, refocus, and refract electromagnetic energy for constructively adding gain in a far-field, the lens configured to operably couple with an antenna, whereby electromagnetic energy is omnidirectionally concentrated, whereby antenna gain and directivity are improved, whereby antenna efficiency and antenna frequency range are maintained, and whereby antenna complexity is minimized, in accordance with an embodiment of the present disclosure.

BRIEF DESCRIPTION OF THE DRAWING(S)

The above, and other, aspects, features, and benefits of several embodiments of the present disclosure are further understood from the following Detailed Description of the Invention as presented in conjunction with the following several figures of the drawings.

Figure 1:
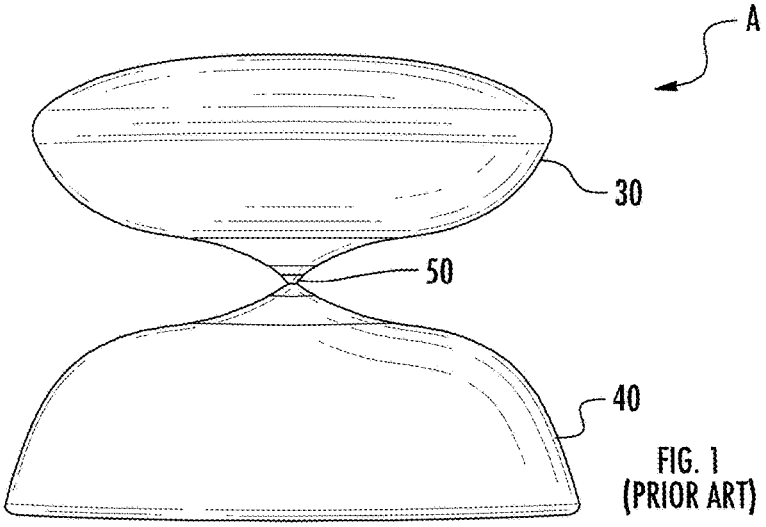
FIG. 1 (PRIOR ART)
FIG. 1 is a diagram illustrating a side view of an antenna, in accordance with the prior art.

Corresponding reference numerals or characters indicate corresponding components throughout the several figures of the drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiment are often not depicted in order to facilitate a less obstructed view of these various embodiments of the present disclosure.

DETAILED DESCRIPTION OF THE EMBODIMENT(S)

Figure 2A:
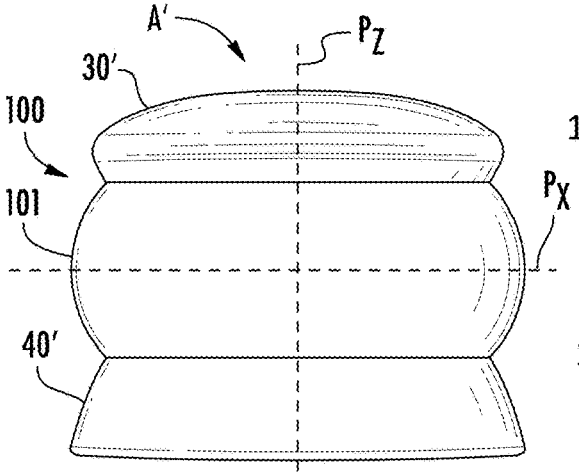
FIG. 2A is a diagram illustrating a side view of a lens apparatus, comprising lens, such as a convex lens, operably coupled with an antenna, such as a bicone antenna, in accordance with an embodiment of the present disclosure.
Figure 2B:
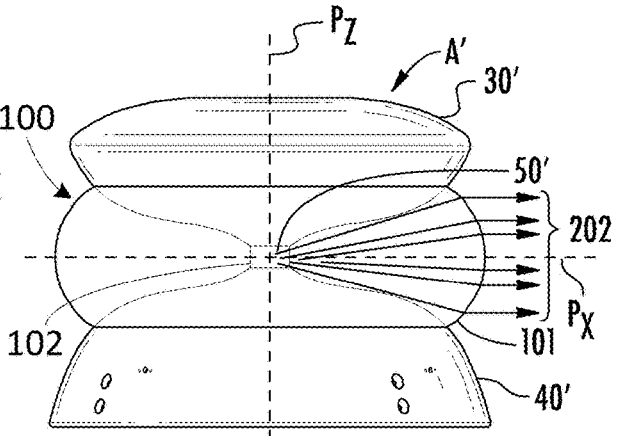
FIG. 2B is a diagram illustrating a cross-sectional side view of a lens apparatus, comprising a lens, such as a convex lens, operably coupled with an antenna, such as a bicone antenna, wherein the lens performs at least one of focus, refocus, and refract electromagnetic energy, as shown in FIG. 2A, in accordance with an embodiment of the present disclosure.

FIGS. 2A and 2B, illustrate, in a side view, a lens apparatus 100, comprising a lens 101 and a coupling feature 102. The lens apparatus 100 shown in FIGS. 2A and 2B is operably coupled with an antenna A', which in this embodiment is a bicone antenna, comprising an upper antenna element 30' and a lower antenna element 40'. The lens 101 may be configured to focus, refocus, and/or refract electromagnetic energy for constructively adding gain in a far-field. The lens 101 is configured to operably couple with an antenna A', whereby electromagnetic energy is omnidirectionally concentrated, whereby antenna gain and directivity are improved, whereby antenna efficiency and antenna frequency range are maintained, and whereby antenna complexity is minimized.

Still referring to FIG. 2A, the lens apparatus 100 maximizes the directivity and antenna efficiency of an antenna A' by allowing electromagnetic energy to act as a travelling wave by way of a logarithmic curve that is extended across the antenna A' in an x-plane $P_x$, shown in relation to a z-plane direction $P_z$. The lens 101 comprises at least one shape of a spheroidal shape, a convex shape, a toroidal shape, a ring toroidal shape, a horn toroidal shape, a spindle toroidal shape, a lemniscate shape, a lemnsicate of Bernoulli shape, a lemnsicate of Booth shape, lemniscate of Gerono shape, a paraboloid of revolution shape, and a hyperboloid of revolution shape, for at least one of focusing, refocusing, and refracting electromagnetic energy being radiated from the antenna A' in the far-field, thereby increasing antenna directivity. In addition, the lens 101 retains the upper antenna element 30' in relation to the lower antenna element 40'. The lens 101 is configurable for focusing energy in a given implementation by configuring the lens 101 in relation to parameters, such as shape, material, dielectric properties, and tangent loss properties. The lens 101 has a dielectric constant in a range of at least approximately 2, e.g., approximately 2.1, preferably in a range of at least approximately 5, and at least one tangent loss property, e.g., a tangent loss in a range of approximately 0.0003 to approximately 0.0004. For example, the lens 101 may be made of polypropylene. However, it is to be understood that the lens 101 may be made of other materials having a refractive index appropriate for any given implementation of the lens apparatus 100.

Referring to FIG. 2B, this diagram illustrates, in a side view, where the lens 101 is depicted as being transparent so as to reveal the coupling feature 102. Also shown in FIG. 2B are electromagnetic rays 202. As can be seen in FIG. 2B, the lens apparatus 100 focuses and refracts the electromagnetic energy, emanating from a feed 50'.

Figure 3A:
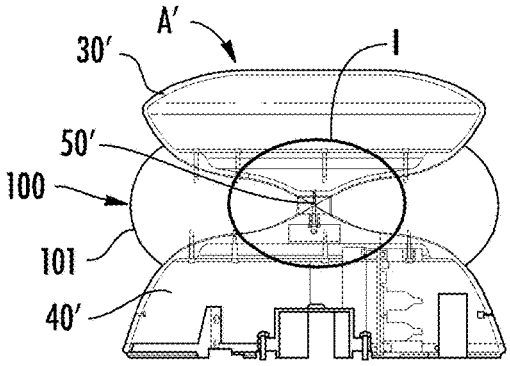
FIG. 3A is a diagram illustrating a cross-sectional side view of a lens apparatus, comprising a lens, such as a convex lens, operably coupled with an antenna, such as a bicone antenna having a feed and a coupling feature, shown by an inset view, wherein the lens performs at least one of focus, refocus, and refract electromagnetic energy, in accordance with an embodiment of the present disclosure.

Referring to FIG. 3A, this diagram illustrates, in a cross-sectional side view, an embodiment of the lens apparatus 100. The electromagnetic energy travels (is transmitted) from the feed 50', such as an RF cable or a feed cable, into the antenna A', and, subsequently, travels (is transmitted) into at least one of the air, a vacuum, and a partial vacuum. The feed 50', such as an RF cable or a feed cable, is impedance-matched to the lens material, by example only. Once the electromagnetic energy begins to exit (commences transmission from) the antenna, the lens 101 concentrates and transmits the electromagnetic energy into the air.

Figure 3B:
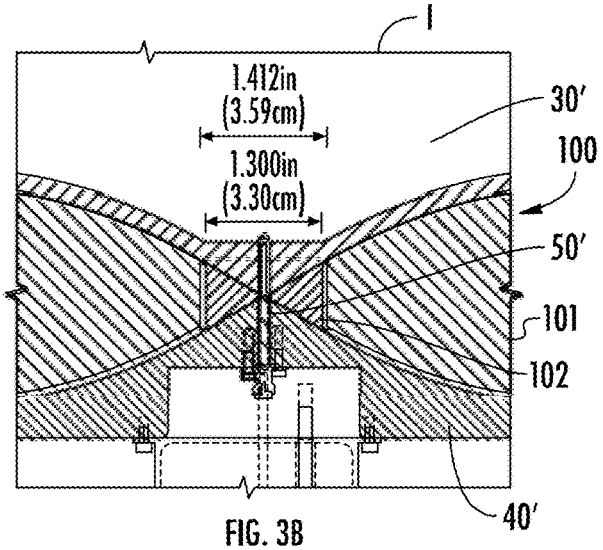
FIG. 3B is a diagram illustrating a cross-sectional side view of the coupling feature in the inset view, as shown in FIG. 3A, in accordance with an embodiment of the present disclosure.

Referring to FIG. 3B, this diagram illustrates, in a cross-sectional side view, the coupling feature 102 in the inset view I, as shown in FIG. 3A, in accordance with an embodiment of the lens apparatus 100. This embodiment of the coupling feature 102 is shown with example dimensions (in both units of centimeters and inches), for accommodating the feed 50' and coupling the upper antenna element 30' with the lower antenna element 40'. The lens 101 comprises a material having an index of refraction that causes the electromagnetic energy to change direction, e.g., in a desired direction. The index of refraction for the lens material is expressed as follows: index of refraction n=(speed of light in a vacuum)/(speed of light in the material)=c/v.

According to Snell'sLaw of Refraction, when light travels from a material with a refractive index $n_1$ into a material with a refractive index $n_2$, the refracted ray, the incident ray, and the ray, corresponding to a vector that is normal in relation to the interface between the two materials, all lie in the same plane; and the angle of refraction $\theta_2$ is related to the angle of incidence $\theta_1$ by the expression: $n_1 \sin \theta_1 = n_2 \sin \theta_2$. By example only, the lens 101 changes direction of the electromagnetic energy from the antenna A' into the air by an angular amount that is based approximately on Snell's Law, e.g., wherein the incident energy $\theta_1$ changes direction to $\theta_2$ approximately based on the index of refraction of the lens material and the air (or vacuum or partial vacuum). In antennas, due to antenna theory reciprocity, an opposite relationship is true if the electromagnetic energy is travelling in an opposite direction.

The lens 101 may take the form of various general lenses. Suitable example shapes of the lens 101 include, but are not limited to, a spheroidal shape, a convex shape, a toroidal shape, a ring toroidal shape, a horn toroidal shape, a spindle toroidal shape, a lemniscate shape, a lemnsicate of Bernoulli shape, a lemnsicate of Booth shape, lemniscate of Gerono shape, a paraboloid of revolution shape, and a hyperboloid of revolution shape.

Figure 4:
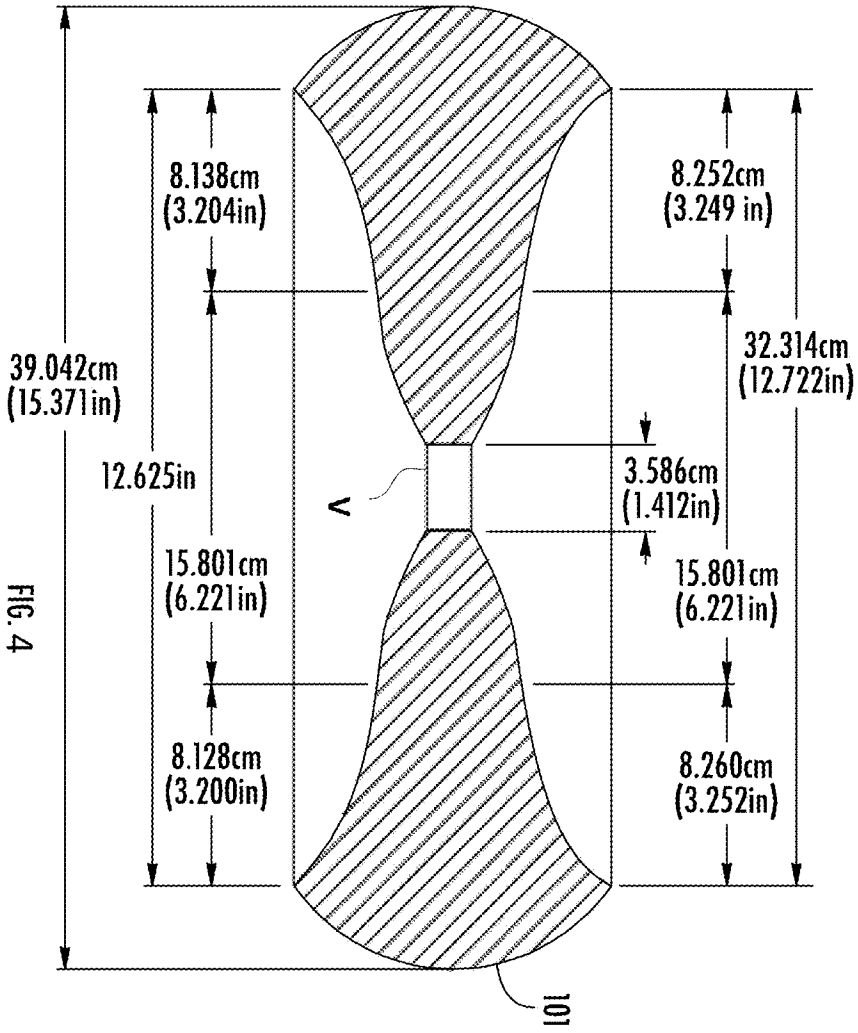
FIG. 4 is a diagram illustrating a cross-sectional side view of a lens apparatus having a void, shown with example dimensions, in accordance with an embodiment of the present disclosure.

FIG. 4 illustrates, in a cross-sectional side view, an embodiment of the lens 101, shown with example dimensions (in both units of centimeters and inches). The void V in the lens 101 is nearly completely filled with the coupling apparatus 102, as shown in FIG. 3B. In other words, the void V accommodates the coupling feature 102 disposed between the lens 101 and a feed 50' of the antenna A' as shown in FIG. 3B.

Referring back to FIG. 3B, the coupling feature 102 is disposed to materially fill in an entire volume from the feed 50' to the lens 101. The embodiment of the coupling feature 102 shown in FIG. 3B is cylindrical in shape so as to fit within the void V and with nearly conical depressions in opposite sides to accommodate the upper antenna element 30' and the lower antenna element 40' as shown in FIG. 3B. However, it is to be understood that the coupling feature 102 may have any desired shape (e.g., cube shape, rectanguloid shape) that fits within the volume between the upper antenna element 30' and the lower antenna element 40' and the lens 101. The coupling feature 102 comprises the same material as the lens 101 and has a tight tolerance in relation to the feed 50', whereby the coupling feature 102 is integrated with the lens 101, and whereby fabrication of the lens apparatus 101 is facilitated. The coupling feature 102 accommodates the feed 50' and couples the upper antenna element 30' with the lower antenna element 40'.

Figure 5A:
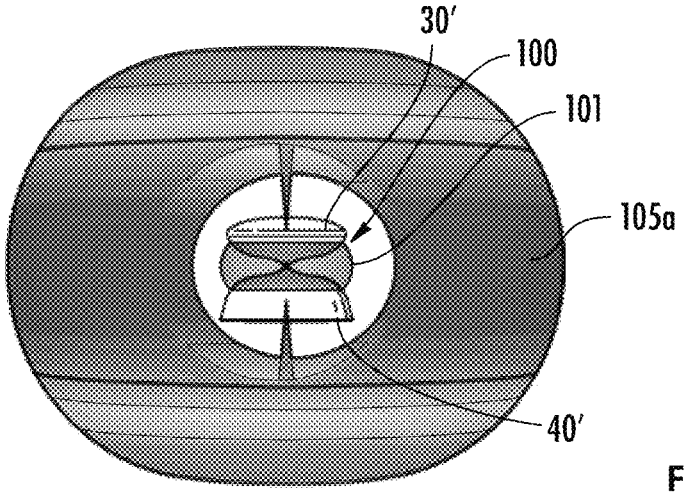
FIG. 5A is a diagram illustrating a side view of an improved antenna radiation pattern effected by, and exemplifying low frequency performance of, a lens apparatus, in accordance with an embodiment of the present disclosure.
Figure 5B:
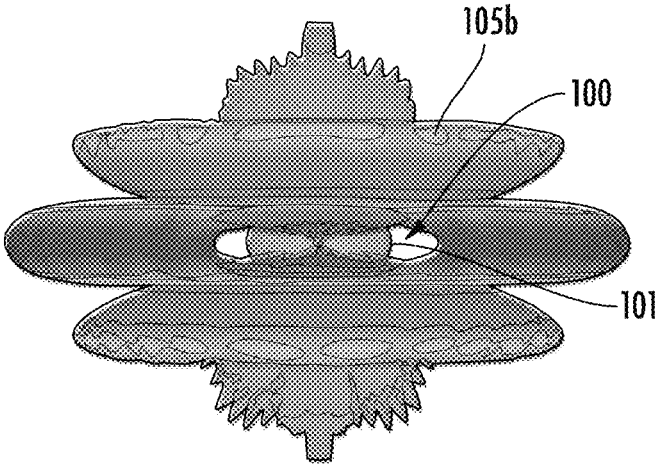
FIG. 5B is a diagram illustrating a side view of an improved antenna radiation pattern effected by, and exemplifying high frequency performance of, a lens apparatus, in accordance with an embodiment of the present disclosure.
Figure 5C:
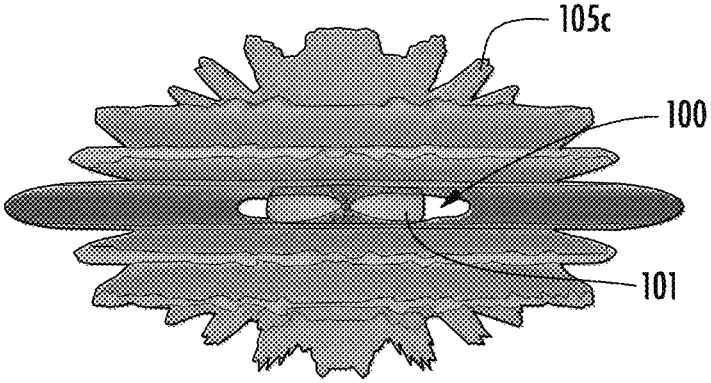
FIG. 5C is a diagram illustrating a side view of an improved antenna radiation pattern 105*c* effected by, and exemplifying very high frequency performance of, a lens apparatus, in accordance with an embodiment of the present disclosure.

FIGS. 5A, 5B, and 5C respectively illustrate, an improved antenna radiation pattern 105*a* within an ultra-high frequency (UHF) band (i.e., between 300 megahertz (MHz) and 3 gigahertz (GHz)), the X-band frequency (i.e., approximately 7.0-11.2 GHz), and the Ku band (approximately 12-18 GHz) of an omnidirectional antenna, bicone antenna as modified by an embodiment of the lens apparatus 100. The lens 101 focuses and refracts electromagnetic energy, and the performance of the lens apparatus 100 improves as the lens size becomes electrically larger in relation to the wavelength (wavelength=velocity of light/frequency), in accordance with an embodiment of the present disclosure.

Figure 6:
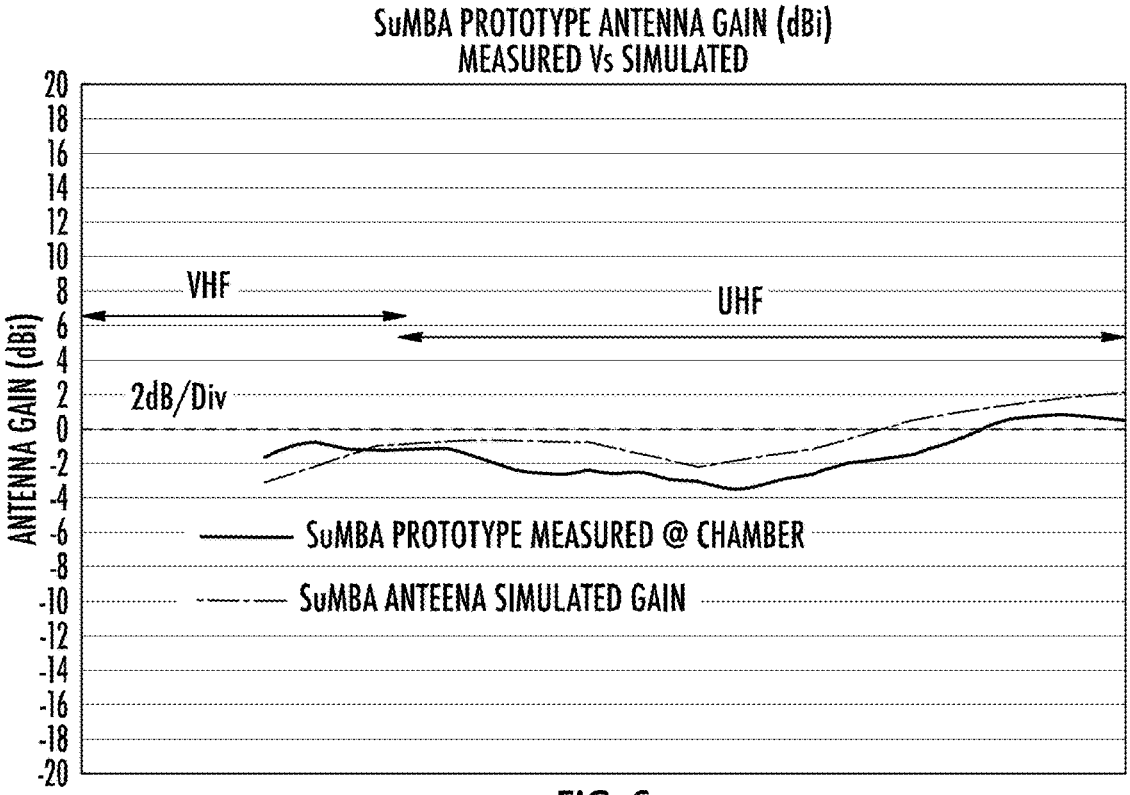
FIG. 6 is a graph illustrating a simulated antenna gain, as a function of frequency range, at lower frequencies, of an antenna operably coupled with the general or simulated lens apparatus, in relation to a measured (at chamber) antenna gain of an antenna operably coupled with a prototype lens apparatus, in accordance with embodiments of the present disclosure.

Referring to FIG. 6, this graph illustrates a simulated antenna gain, as a function of frequency range, at low frequencies and higher low frequencies, of a simulated antenna operably coupled with the simulated lens apparatus, in relation to a measured (at chamber) antenna gain of an antenna A' operably coupled with the embodiment of the lens apparatus 100 shown in FIG. 3A. The data in FIG. 6 is obtained from tests conducted to validate data simulated by the CST Microwave Studio® software. As such, the measured gain of the antenna A' is close to the simulated gain of the CST Microwave Studio® software at low frequencies and higher low frequencies.

Figure 7:
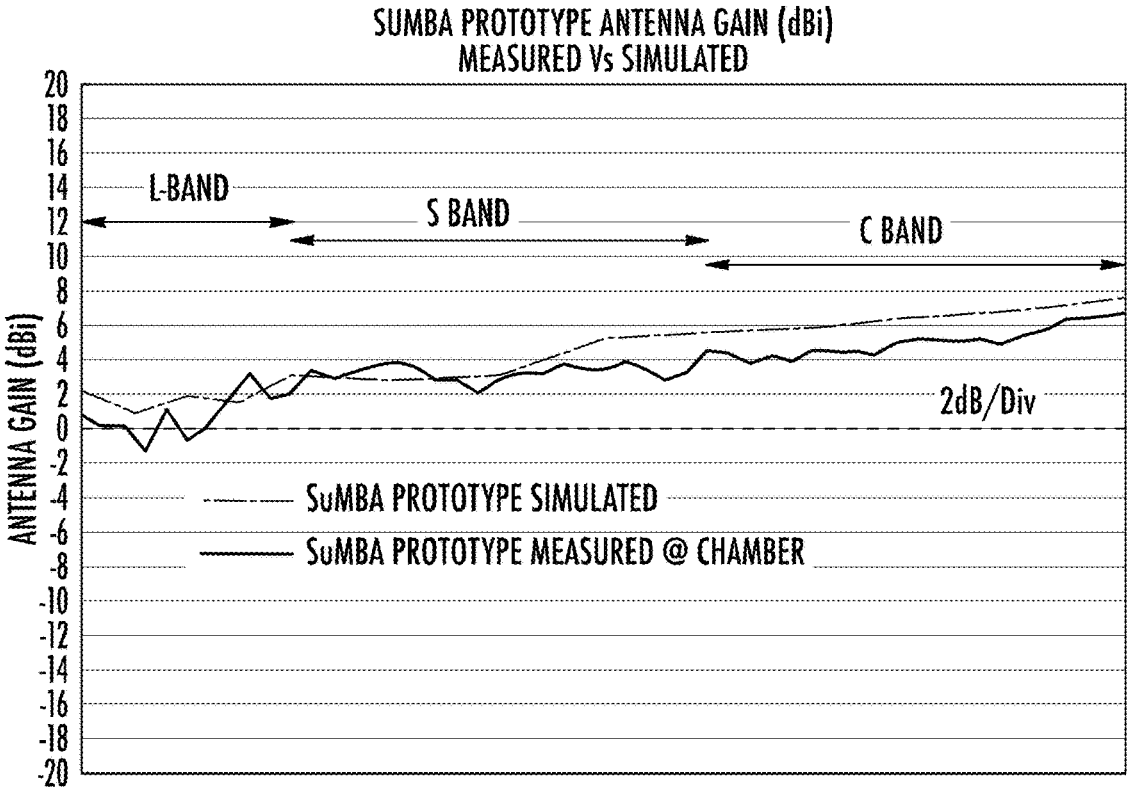
FIG. 7 is a graph illustrating another simulated antenna gain, as a function of frequency range, at higher frequencies, of an antenna operably coupled with the general or simulated lens apparatus, in relation to a measured (at chamber) antenna gain of an antenna operably coupled with the prototype lens apparatus, in accordance with embodiments of the present disclosure.

Referring to FIG. 7, this graph illustrates a simulated antenna gain, as a function of frequency range, such as low frequencies, medium frequencies, and a high range of high frequencies, of a simulated antenna operably coupled with the simulated lens apparatus, as shown in FIG. 3A, in relation to a measured (at chamber) antenna gain of an antenna A' operably coupled with the embodiment of the lens apparatus 100 shown in FIG. 3A. As such, the measured gain of the antenna A' is close to the gain simulated by the CST Microwave Studio® software low frequencies, medium frequencies, and a high range of high frequencies.

Figure 8:
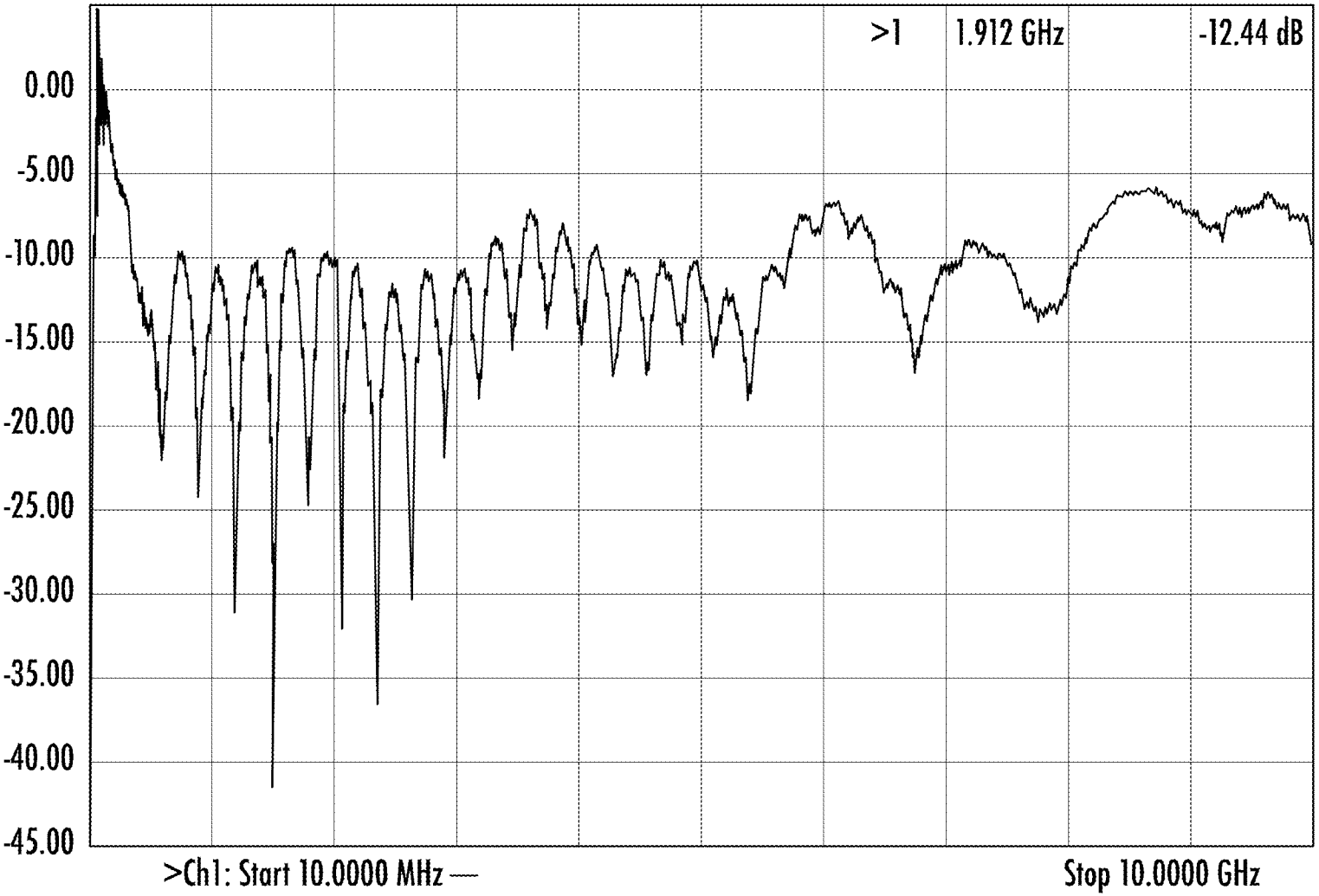
FIG. 8 is a graph illustrating a return-loss, as a function of frequency range, of an antenna operably coupled with a lens apparatus, in accordance with embodiments of the present disclosure.

Referring to FIG. 8, this graph illustrates a return-loss (in dB), as a function of frequency range (in Hz), e.g., in a range of approximately 10 MHz to approximately 10 GHz, of an antenna A' operably coupled with a lens apparatus 100, in accordance with embodiments of the present disclosure. Return loss is a loss of power in a signal that is returned or reflected by a discontinuity in an antenna transmission. By example only, the return loss is approximately −12.44 dB at approximately 1.912 GHz by implementing the lens apparatus 100.

Figure 9A:
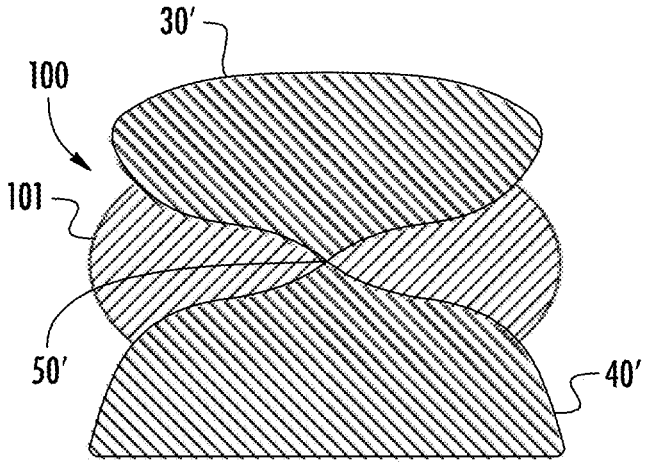
FIG. 9A is a diagram illustrating a cross-sectional side view of a lens apparatus that is scalable in at least one of size and shape in at least one plane, wherein the lens apparatus has an aspect ratio, for example, in accordance with an alternative embodiment of the present disclosure.
Figure 9B:
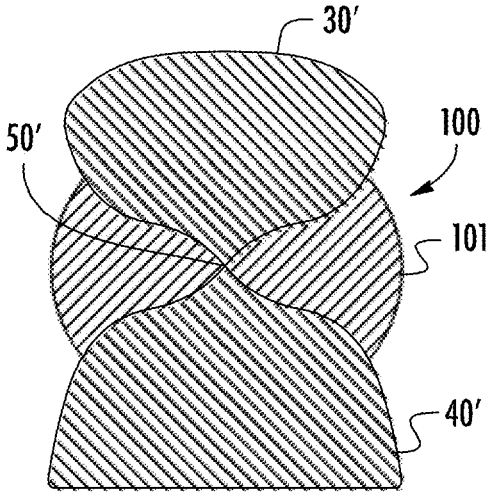
FIG. 9B is a diagram illustrating a cross-sectional side view of a lens apparatus, that is scalable in at least one of size and shape in at least one plane, wherein the lens apparatus has a higher aspect ratio than that shown in FIG. 13A, for example , in accordance with an alternative embodiment of the present disclosure.
Figure 9C:
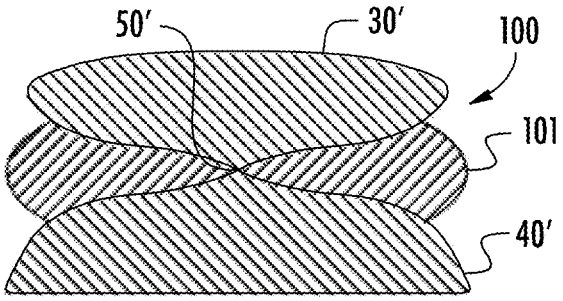
FIG. 9C is a diagram illustrating a cross-sectional side view of a lens apparatus, that is scalable in at least one of size and shape in at least one plane, wherein the lens apparatus has a lower aspect ratio than that shown in FIG. 13A, for example, in accordance with an alternative embodiment of the present disclosure.

FIGS. 9A, 9B, and 9C illustrate, in a cross-sectional side view, different embodiments of the lens apparatus 100 with different embodiments of bicone, omnidirectional antennas. The lens apparatus 100 may be used with any known ultrawideband antenna.

Figure 10:
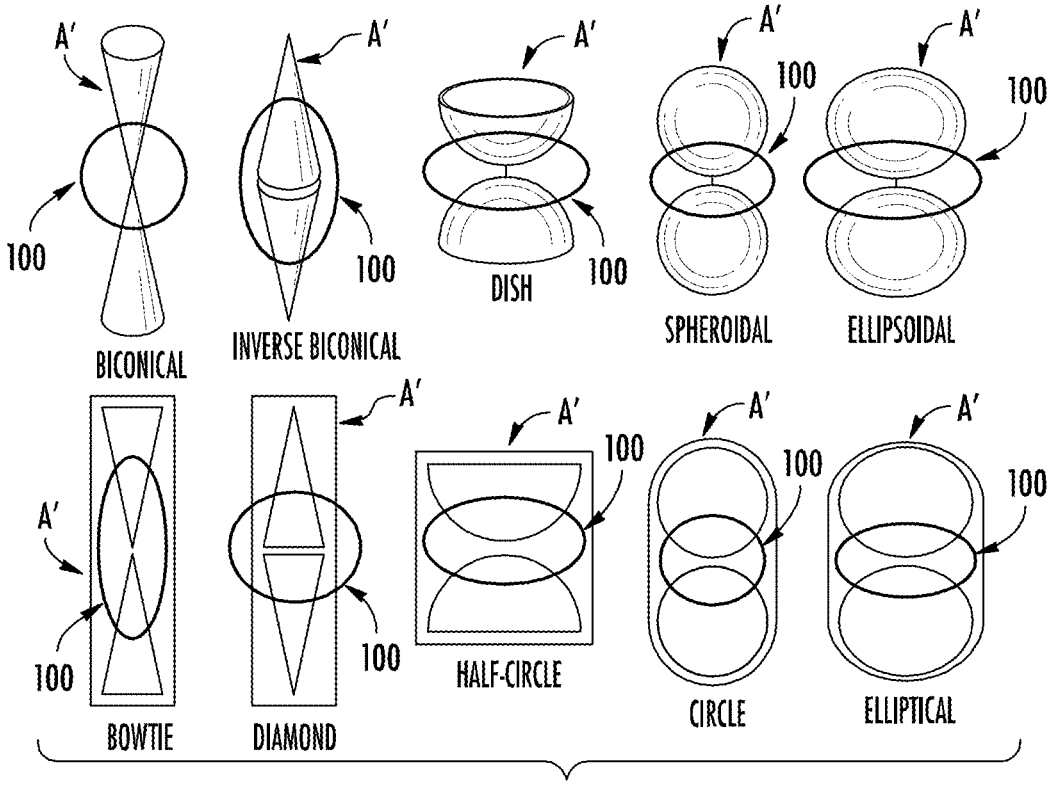
FIG. 10 is a diagram illustrating side views, and cross-sectional side views, of various lens apparatuses, implemented with various lens apparatuses, in accordance with various alternative embodiments of the present disclosure.

FIG. 10 is a diagram illustrating side views, and cross-sectional side views, of various lens apparatuses 100, comprising lenses 101, such as a convex lens, implemented with various antennas A', such as bi-element antennas, in accordance with various alternative embodiments of the present disclosure.

Figure 11:
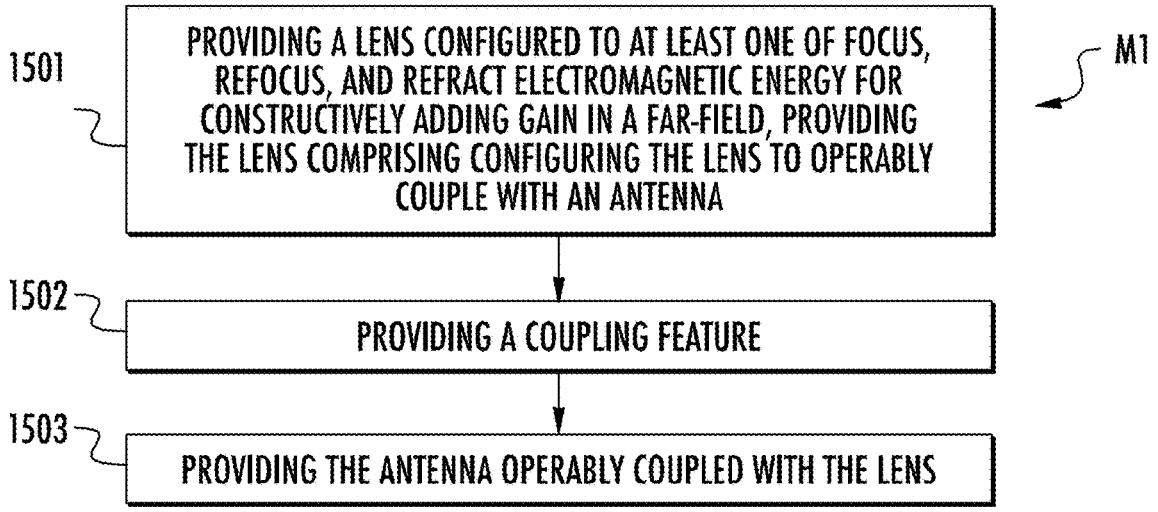
FIG. 11 is a flow diagram illustrating a method of providing a lens apparatus for improving performance of an antenna, in accordance with an embodiment of the present disclosure.

Referring to FIG. 11, this flow diagram illustrates a method M1 of providing a lens apparatus 100 for improving performance of an antenna A', in accordance with an embodiment of the present disclosure. The method M1 comprises: providing a lens 101 configured to at least one of focus, refocus, and refract electromagnetic energy for constructively adding gain in a far-field, providing the lens 101 comprising configuring the lens 101 to operably couple with an antenna A', as indicated by block 1501, whereby electromagnetic energy is omnidirectionally concentrated, whereby antenna gain and directivity are improved, whereby antenna efficiency and antenna frequency range are maintained, and whereby antenna complexity is minimized.

Still referring to FIG. 11, in the method M1, providing the lens 100, as indicated by block 1500, comprises configuring the lens 100 in at least one shape of a spheroidal shape, a convex shape, a toroidal shape, a ring toroidal shape, a horn toroidal shape, a spindle toroidal shape, a lemniscate shape, a lemnsicate of Bernoulli shape, a lemnsicate of Booth shape, lemniscate of Gerono shape, a paraboloid of revolution shape, and a hyperboloid of revolution shape; providing the lens 100, as indicated by block 1501, comprises providing at least one material of polypropylene and the like; providing a lens 100, as indicated by block 1501, comprises configuring the lens 100 with at least one dielectric property, such as a dielectric constant in a range of at least approximately 2, e.g., approximately 2.1, preferably in a range of at least approximately 5; providing lens 100, as indicated by block 1501, comprises configuring the lens with at least one tangent loss property, such as a tangent loss in a range of approximately 0.0003 to approximately 0.0004; providing the lens 100, as indicated by block 1501, comprises configuring the lens 100 with a refractive index in a range of approximately 1.4 to approximately 10.

Still referring to FIG. 11, the method M1 further comprises providing a coupling feature 102, as indicated by block 1502, for coupling an upper antenna element 30' with a lower antenna element 40' and for accommodating a feed 50'. Providing the coupling feature 102, as indicated by block 1502, comprises configuring the coupling feature 102 with at least one of a refractive index matching that of the lens 101 and a material matching that of the lens 101.

Still referring to FIG. 11, the method M1 further comprises providing the antenna A' operably coupled with the lens 101, as indicated by block 1503, wherein providing the antenna A', as indicated by block 1503, comprises providing at least one of a biconical antenna, an inverse biconical antenna, a dish antenna, an omnidirectional antenna, an omnidirectional antenna system, a spherical antenna, a bi-spherical antenna, an ellipsoidal antenna, a bi-ellipsoidal antenna, a bow-tie antenna, a diamond-shaped antenna, a bi-diamond-shaped antenna, a semi-circular antenna, a bi-semicircular antenna, a circular antenna, a bi-circular antenna, an elliptical antenna, and a bi-elliptical antenna.

Figure 12:
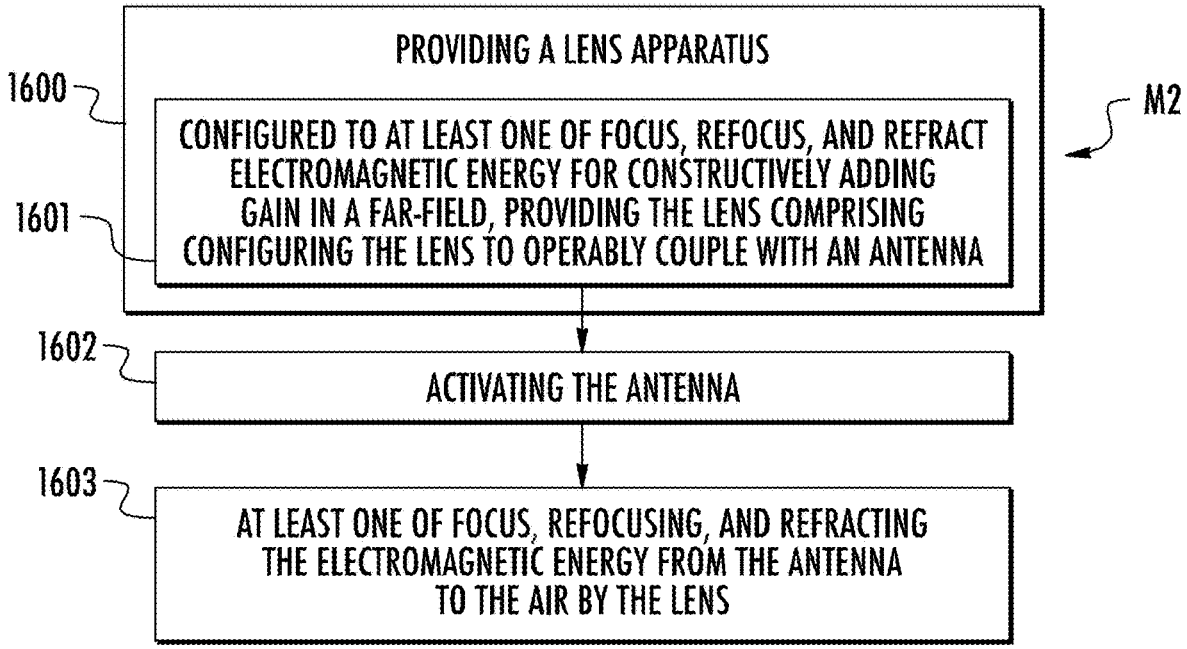
FIG. 12 is a flow diagram illustrating a method of improving performance of an antenna by way of a lens apparatus, in accordance with an embodiment of the present disclosure.

Referring to FIG. 12, this flow diagram illustrates a method M2 of improving performance of an antenna A by way of a lens apparatus 100, in accordance with an embodiment of the present disclosure. The method M2 comprises: providing a lens apparatus 100 for improving antenna performance, as indicated by block 1600, providing the lens apparatus 100 comprising: providing a lens 101 configured to at least one of focus, refocus, and refract electromagnetic energy for constructively adding gain in a far-field, providing the lens 101 comprising configuring the lens 101 to operably couple with an antenna A', as indicated by block 1601; A', as indicated by block 1602; and at least one of focusing, refocusing, and refracting the electromagnetic energy from the antenna A' to the air by the lens 101, as indicated by block 1603, thereby omnidirectionally concentrating electromagnetic energy, thereby improving antenna gain and directivity, thereby maintaining antenna efficiency and antenna frequency range, and thereby minimizing antenna complexity.

Still referring to FIG. 12, in the method M2, providing the lens apparatus 100, as indicated by block 1600, further comprises providing a coupling feature 102 for coupling an upper antenna element 30' with a lower antenna element 40' and for accommodating a feed 50'. Providing the coupling feature 102 comprises configuring the coupling feature 102 with at least one of a refractive index matching that of the lens 101 and a material matching that of the lens 101.

Still referring to FIG. 12, in the method M2, providing the lens apparatus 100, as indicated by block 1600, further comprises providing the antenna A' operably coupled with the lens 101, wherein providing the antenna A' comprises providing at least one of a biconical antenna, an inverse biconical antenna, a dish antenna, an omnidirectional antenna, an omnidirectional antenna system, a spherical antenna, a bi-spherical antenna, an ellipsoidal antenna, a bi-ellipsoidal antenna, a bow-tie antenna, a diamond-shaped antenna, a bi-diamond-shaped antenna, a semi-circular antenna, a bi-semicircular antenna, a circular antenna, a bi-circular antenna, an elliptical antenna, and a bi-elliptical antenna.

In embodiments of the present disclosure, the lens apparatus 100 may be matched in impedance with the antenna A'. The lens apparatus 100 facilitates low-level and high-level testing of an antenna system and associated radio frequency (RF) components, e.g., in a production setting, wherein measurement of quality and fidelity is improved, facilitates processing and presenting measured test data, and facilitates modifying and improving test procedures.

In embodiments of the present disclosure, the lens apparatus 100 is operable with an antenna, whereby a communications range is improvable. The lens apparatus 100 is operable by facilitating obtaining measured data for verifying system performance and providing insight into how the antenna system will behave in real-world conditions. The lens apparatus 100 is operable by facilitating testing performance of an antenna and RF system by using various RF test equipment, such as a vector network analyzer (VNA), a spectrum analyzer, and an RF signal generator, to test performance of antenna and RF system. The lens apparatus 100 is operable by facilitating test component performance at different temperatures as per mission requirements by using a thermal chamber.

It will be understood that many additional changes in the details, materials, steps and arrangement of parts, which have been herein described and illustrated to explain the nature of the invention, may be made by those skilled in the art within the principle and scope of the invention as expressed in the appended claims.

What is claimed:

1. A radio frequency (RF) lens apparatus for improving omnidirectional antenna performance of an antenna having an upper element and a lower element that are coupled to a feed situated between the upper element and the lower element, the apparatus comprising:

a dielectric material disposed between the upper element and the lower element so as to fill a volume between the upper element and the lower element and to surround the feed, wherein the dielectric material forms a spherical lens at an interface between the dielectric material and air such that incident RF energy is focused on the feed between the upper and lower antenna elements and such that outgoing RF energy from the feed is concentrated by the spherical lens so as to add gain in a far-field.

2. The apparatus of claim 1, wherein the lens is a convex lens.

3. The apparatus of claim 1, wherein the dielectric material is polypropylene.

4. The apparatus of claim 1, wherein the lens comprises a dielectric constant in a range of at least approximately 2.

5. The apparatus of claim 1, wherein the lens comprises a tangent loss in a range of approximately 0.0003 to approximately 0.0004.

6. The apparatus of claim 1, wherein the lens comprises a refractive index in a range of approximately 1.4 to approximately 10.

7. The apparatus of claim 1, wherein the lens surrounds the feed and is configured to hold the lower and upper elements in place with respect to each other.

8. The apparatus of claim 7, wherein the feed is coupled to an RF cable that is impedance matched to the dielectric material.

9. The apparatus of claim 1, further comprising the antenna operably coupled with the lens.

10. The apparatus of claim 1, wherein the antenna is selected from the group consisting of: a biconical antenna, an inverse biconical antenna, a dual-element dish antenna, a dual-element spheroidal antenna, dual-element ellipsoidal antenna, a bow-tie antenna, a diamond-shaped antenna wherein the upper and lower elements are upper and lower halves of a diamond shape, a dual-element half circle antenna, a dual-circular-element antenna, and a dual-elliptical-element antenna.

11. A radio frequency (RF) lens for an antenna having an upper element and a lower element that are connected to a feed, the RF lens comprising:

a dielectric material disposed between the upper element and the lower element so as to fill a volume between the upper element and the lower element and to surround the feed, wherein the dielectric material forms a spherical lens at an interface between the dielectric material and air such that incident RF energy is focused on the feed between the upper and lower antenna elements and such that outgoing RF energy from the feed is concentrated by the spherical lens in a far-field direction, thereby increasing antenna directivity and gain in the far-field.

12. The RF lens of claim 11, wherein the dielectric material holds the upper and lower elements in place with respect to each other.

13. The RF lens of claim 12, wherein the volume excludes a void between the dielectric material and the feed.

14. The RF lens of claim 13, wherein the void is separately filled with a coupling feature made of the dielectric material.

15. The RF lens of claim 11, wherein the antenna is selected from the group consisting of: a biconical antenna, an inverse biconical antenna, a dual-element dish antenna, a dual-element spheroidal antenna, dual-element ellipsoidal antenna, a bow-tie antenna, a diamond-shaped antenna wherein the upper and lower elements are upper and lower halves of a diamond shape, a dual-element half circle antenna, a dual-circular-element antenna, and a dual-elliptical-element antenna.

16. The RF lens of claim 15, wherein a contoured surface of the upper element and a contoured surface of the lower element are defined by respective logarithmic curves that are rotated about a vertical axis such that tips of the upper and lower elements meet at the feed.

17. The RF lens of claim 16, wherein the dielectric material has an outer diameter that is at least as great as a greatest outer diameter of the upper and lower elements.

18. The RF lens 16, further comprising the antenna operably coupled to the dielectric material.

* * * * *